US007094821B2

(12) United States Patent
Kruse et al.

(10) Patent No.: US 7,094,821 B2
(45) Date of Patent: Aug. 22, 2006

(54) METHOD OF MAKING TUNGSTEN CARBIDE BASED HARD METAL TOOLS OR COMPONENTS

(75) Inventors: Olof Kruse, Fagersta (SE); Johnny Bruhn, Västerfärnebo (SE)

(73) Assignee: Seco Tools AB, Fagersta (SE)

( * ) Notice: Subject to any disclaimer, the term of this patent is extended or adjusted under 35 U.S.C. 154(b) by 450 days.

(21) Appl. No.: 10/724,051

(22) Filed: Dec. 1, 2003

(65) Prior Publication Data

US 2004/0206203 A1 Oct. 21, 2004

(30) Foreign Application Priority Data

Dec. 2, 2002 (SE) ..... 0203559

(51) Int. Cl.
*C04B 35/634* (2006.01)
*C04B 35/56* (2006.01)
*B22B 3/12* (2006.01)

(52) U.S. Cl. ..... 524/322; 106/243; 501/87; 501/93; 75/252; 419/15; 419/18

(58) Field of Classification Search ..... 524/322; 106/243; 501/87, 93; 75/252; 419/15, 18
See application file for complete search history.

(56) References Cited

U.S. PATENT DOCUMENTS

2003/0124017 A1 7/2003 Kruse
2004/0138049 A1* 7/2004 Yasrebi et al. ..... 501/127

FOREIGN PATENT DOCUMENTS

EP 1 153 652 A1 11/2001

OTHER PUBLICATIONS

Oliverkra et al, "Deflocculation of Al203-SiC Suspensions", www.ceramicbullentin.org, (Feb. 2001).*
Zhang et al, "Aqueous Processing of SiC Green Sheets I:Dispersant", J. Mater. Res., vol. 17, No. 8, (Aug. 2002).*
E. Laarz et al., "Dispersing WC-Co powders in aqueous media with polyethylenimine", International Journal of Refractory Metals and Hard Materials 18 (2000), pp. 281-286, no month provided.
Abstract of Swedish Patent Application No. 0104309-0 published Aug. 12, 2003.

* cited by examiner

*Primary Examiner*—David Brunsman
(74) *Attorney, Agent, or Firm*—Drinker Biddle & Reath LLP

(57) ABSTRACT

Preparation, handling, and spray drying, in an economic and environmentally-friendly way, of slurries for the production of tungsten carbide based hard metal tools or components by the powder injection molding or extrusion route is disclosed. The slurry used is based on ethanol-water and contains metal carbide and metallic raw materials as well as stearic acid and a low concentration of polyethylenimine (PEI). The concentration of PEI is 0.01–1 wt % of the raw material weight. This combination results in low-viscous slurries, which require less use of ethanol, energy, manpower, and equipment time in their preparation, handling, and spray drying. The invention also relates to the powder obtained by using the method.

9 Claims, No Drawings

METHOD OF MAKING TUNGSTEN CARBIDE BASED HARD METAL TOOLS OR COMPONENTS

This application claims priority under 35 U.S.C. §119 to Swedish Application No. 0203559-0 filed in Sweden on Dec. 2, 2002; the entire contents of which is hereby incorporated by reference.

FIELD OF THE INVENTION

The present invention relates to economic and environmentally-friendly preparation, handling, and spray drying of slurries, as well as pelletizing powder. For example, the invention relates to methods for the production of tungsten carbide based hard metal tools or components using powder injection molding or extrusion methods.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Hard metals based on tungsten carbide include composites consisting of small (μm-scale) grains of at least one hard phase in a binder phase. In these materials, the hard phase tungsten carbide (WC) is always present. In addition, other metal carbides with a general composition (Ti,Nb,Ta,W)C may also be included, as well as metal carbonitrides, e.g., Ti(C,N). The binder phase usually consists of cobalt (Co). Other binder phase compositions may also be used, e.g., combinations of Co, Ni, and Fe, or Ni and Fe.

Industrial production of tungsten carbide based hard metals often include blending of given proportions of raw materials and additives with a milling liquid. This liquid is often an alcohol, e.g., ethanol, water, or a mixture thereof. The blend is then milled into a homogeneous slurry. The wet milling operation is made with the purpose of deagglomerating and intimately mixing the raw materials. Individual raw material grains are also disintegrated to some extent. The slurry is then dried and granulated, e.g., by means of a spray drier. The granulate may then be used in uniaxial pressing of green bodies, generally with PEG (polyethylene glycol) added as pressing agent. Alternatively, stearic acid may be used as an additive when the material is to be used for extrusion or injection molding.

Injection molding is common in the plastics industry, where material containing thermoplastics or thermosetting polymers are heated and forced into a mold with the desired shape. The method is often referred to as Powder Injection Molding (PIM) when used in powder technology. The method is expensive compared to uniaxial pressing and is hence preferably used for parts with complex geometry.

In powder injection molding of tungsten carbide based hard metal parts, four consecutive steps are applied:

1. Mixing of the hard metal raw materials with a polymer system. The polymer system acts as a binder and constitutes 25–55 volume % of the resulting compound. The exact concentration is dependent on the desired process properties during molding. The mixing is made with all organic constituents in molten state in an extruder. The resulting compound is obtained as pellets of approximate size 2×4 mm.

2. Injection molding using the compounded feedstock. The material is heated to 100–240° C. and then forced into a cavity with the desired shape. The part is cooled and then removed from the cavity.

3. Removing the binder from the obtained part. The removal can be obtained by wet extraction of the parts or by heating in a furnace with suitable gases present, or a combination thereof.

4. Sintering of the parts. Common sintering procedures for hard metals are applied.

The above-mentioned processes require the use of alcohol, energy, equipment time, and manpower. It would be desirable to reduce these needs for economical and ecological reasons.

The article "Dispersing WC-Co powders in aqueous media with polyethylenimine" (E. Laarz and L. Bergstrom, International Journal of Refractory Metals & Hard Materials, 18, 2000, pp. 281–286) gives an account of PEI (polyethylenimine, a cationic polyelectrolyte) in slurries of tungsten carbide and cobalt in water. PEI acts as a dispersant at concentrations above 0.3% with respect to dry powder weight (wt %).

EP-A-1153652 relates to the preparation of dispersed suspensions of WC and Co in water or water-ethanol mixtures using PEI. In water based slurries with 3.5 wt % PEG present, a dispersing effect of PEI was reported at concentrations above 0.3 wt %. For mixtures of water and ethanol, the lowest concentration of PEI stated to have dispersing effect is 0.3 wt %. The slurry is made from a mixture of 90 wt % ethanol and 10 wt % water with WC, TiC, TaC, TiN, and Co powders. A concentration range of a polyethylenimine-based polyelectrolyte of 0.1–10 wt % is claimed.

Swedish patent application 0104309-0 relates to the addition of low concentrations (0.01–<0.1 wt %) of PEI to slurries containing ethanol, water, PEG, and powdered raw materials for the production of tungsten carbide based hard metals. A radical decrease in slurry viscosity is thus obtained, which can be used to decrease the volume of milling liquid, the milling time, the rinsing liquid volume, and energy use on slurry drying. A concentration range of 0.01–<0.1 wt % of a polyethylenimine-based polyelectrolyte is claimed.

SUMMARY OF THE INVENTION

It has now surprisingly been found that an addition of 0.01–1 wt % PEI to ethanol-water based slurries containing stearic acid and powdered raw materials for the production of tungsten carbide based hard metal tools using powder injection molding gives a radical decrease in slurry viscosity. Thus, slurries with higher powder concentrations can be used. As a result, less ethanol-water mixture is needed during milling of the slurry and also for rinsing of the mill after milling. The lower slurry viscosity gives an increase in milling efficiency and a decrease in the milling time needed. The decrease in ethanol-water volume used gives a decrease in total slurry volume and hence a decrease in both energy requirement and equipment time in the drying of the slurry.

According to one aspect, the present invention provides a method of making a slurry, the slurry comprising tungsten carbide, ethanol, water, and stearic acid, the method comprising adding PEI in an amount of 0.04–0.20 wt % of the raw material weight.

According to a further aspect, the present invention provides a slurry comprising tungsten carbide, ethanol, water, stearic acid, and PEI in an amount of 0.04–0.20 wt % of the raw material weight.

According to yet another aspect, the present invention provides a powder comprising tungsten carbide, stearic acid, and PEI in an amount of 0.04–0.20 wt %.

DETAILED DESCRIPTION

The invention relates to a method of preparing a slurry for making tungsten carbide based hard metal tools or components by powder injection molding or extrusion techniques, the resulting slurry and a powder obtained after drying said slurry.

More specifically, the invention relates to the preparation, handling, and spray drying of slurries to powders to be used for the powder injection molding or extrusion production route of tungsten carbide based hard metal tools or components. The invention can be used for all grain sizes commonly used, however, it has particular usefulness for grain sizes 0.5–5.0 μm. For use in slurries containing WC and Co with less than 1 wt % of TaC, NbC, and TiC in total of the raw material weight, the PEI concentration is 0.05–0.20 wt % of the raw material weight, preferably 0.10–0.16 wt %. For use in slurries containing WC and Co with 1–15 wt % of TaC, NbC, TiC, and/or Ti(C,N) in total of the raw material weight, the PEI concentration is 0.04–0.18 wt %, preferably 0.08–0.15 wt %. The molecular weight (Mw) of the PEI is 1000–50000, preferably 10000–30000. More particularly, during milling the standard slurry consists of a suspension of 72–82 wt % of powdered raw materials (computed on total weight of raw materials and liquid), more preferably 74–80 wt %, in a liquid containing ethanol (65–75 wt %) and water. With PEI, the milling slurry contains 74–84 wt % of powdered raw materials, preferably 76–82 wt %. After diluting the slurry on emptying and rinsing the mill, the standard slurry consists of 62–72 wt % raw materials, preferably 64–70 wt %. With PEI, the slurry contains 65–75 wt % raw materials, preferably 67–73 wt %. In addition to the raw materials mentioned above, small amounts of tungsten metal or carbon black may be included in order to adjust the carbon balance in the sintered material. In the ethanol used, 4 wt % MEK (methyl ethyl ketone) is included. The concentration of stearic acid is 0.1–2.0 wt % of the raw material weight.

Other compounds than the above-mentioned may also be used as raw materials. In one preferred embodiment, zirconium carbide and/or hafnium carbide may be included.

In addition to the above-mentioned hard phases, small amounts, i.e., less than 1 wt %, of chromium carbide and/or vanadium carbide may be added in order to inhibit grain growth during sintering.

The principles of the present invention will now be further described through reference to the following illustrative and non-limiting examples.

EXAMPLE 1

Viscosity was measured on a slurry containing raw materials for the production of a commercial hard metal grade by the injection molding route. The raw material contained 86.4 wt % WC with a grain size of about 0.75 μm (measurement according to Fisher on unmilled sample), 13.0 wt % Co with a grain size (Fisher) of about 0.9 μm, and 0.6 wt % $Cr_3C_2$ with a grain size (Fisher) of about 1.8 μm. Stearic acid was present in a concentration of 0.6 wt %. The milling liquid consisted of an ethanol-water mixture with 70 wt % ethanol. In the slurry, the raw material load was 75.3 wt %. The viscosity was measured at ambient temperature with a Contraves viscometer (1814, TVB) while the slurry was continuously stirred by the viscometer. The viscosity was obtained in arbitrary units specific for the equipment. Into the slurry sample, which was kept in a plastic jar during measurements, a 30 wt % water solution of PEI (obtained from Sigma-Aldrich Sweden, product no. 40,872-7) with an average molecular weight (Mw) of 25000 was added dropwise. The slurry had a viscosity of 70 units before any addition of PEI solution had been made. The viscosity then decreased gradually as solution was added, until a value of 23 units was reached at a concentration of 0.13 wt % PEI. The viscosity then showed only a minor decrease upon adding more solution.

EXAMPLE 2

The ability of a slurry containing PEI to be spray dried into powder and the ability of the powder thus obtained to be sintered into hard metal with uniform microstructure was tested as follows. Slurry containing raw materials for the production of a commercial hard metal grade according to Example 1 was produced in lab scale. Three lab size ball mills with 12 kg hard metal milling balls each were used. Into each mill, 2500 g raw material was loaded. The intended carbon concentration in the raw material was 5.41 wt % and a small amount (1.3 g) carbon black was therefore included in the load. To the raw material, 15 g stearic acid, 10.8 g of 30 wt % PEI solution (as described above), and 940 $cm^3$ milling liquid were added. The milling liquid consisted of an ethanol-water mixture with 70 wt % ethanol. The added amount of PEI corresponded to 0.13 wt % of the raw weight. Milling was made at 44 rev/min during 80 hours. The slurry was then dried into powder in a lab size spray drier. A sample of the powder was pressed uniaxially, dewaxed, presintered, and then sintered by standard production procedures into SNUN120412 pieces. Upon microscope inspection of polished sections of the sintered material, no porosity could be detected. The microstructure was uniform. Measurements of density and coercivity gave average values of 14.16 $g/cm^3$ and 16.6 kA/m, respectively. Both values are within the two sets of specifications for the intended grade, manufactured either by pressing and sintering of powder with PEG, or by the injection molding and sintering route using powder with stearic acid.

EXAMPLE 3

The ability of spray-dried powder containing PEI to be used as raw material for pellets intended for injection molding was tested as follows. Powder as obtained in Example 2 was tested. The equipment used was a Werner & Pfleiderer ZSK 25 twin screw extruder operating between 70 and 170° C. in seven zones. Powder was fed through two separate hoppers operating at different flow rates, and a proprietary binder system was added through a third hopper. The screws had a diameter of 25 mm and were run at 250 rev/min. The material was extruded through a nozzle with two holes with 4 mm diameter and then cut off by a rotating knife into pellets with an approximate size of 4×2 mm. The pellets were cooled in a vibrating chute and then collected in a bin where additional cooling was made by a throughflow of air. The density of the obtained pellets was measured by a Micromeritics Accu Pyc 1330 pycnometer using helium gas and 35–40 gram samples. The material was then rerun through the extruder with more raw powder added successively until the pellet density reached the desired interval (7.90–7.92 $g/cm^3$).

EXAMPLE 4

The pellets obtained in Example 3 were used for injection molding trials for hard metal tools with complex geometries. A commercial end mill family (Minimaster) exhibiting three flutes with one through coolant hole each was chosen. The selected geometries were MM06-06007-A30 and MM16-20015-A30 with mill diameters of 6.0 and 20.0 mm respectively, in the sintered product. The used geometries represent the smallest and largest tools in the family. Injection molding trials were made in two separate units. The small green bodies were produced in a Battenfeld BA 500/200 CDK-SE equipment. The large green bodies were obtained in an equipment specially designed for powder injection molding. The injection molding tests were made with process parameters identical to those used in regular production of the chosen tools. No deviations from normal behavior could be detected during trials.

EXAMPLE 5

The small green bodies obtained in Example 4 were mounted in upright position on ceramic rods through the coolant channels. The rods were fastened vertically into holes drilled in a graphite sintering tray. Dewaxing and sintering was then made in a lab sinterHIP (a Fine Ceramics Technologies FPW 180/250-220-100-SP unit with 4 $dm^3$ volume). Sintering was made at 1400° C. and 30 bar Ar with 25 minutes hold. The material in the sintered pieces showed microstructure, density, and coercivity within the specifications of the intended grade. The obtained size and shape intervals were within the specification for the tool geometry.

EXAMPLE 6

The large green bodies obtained in Example 4 were mounted as described in Example 5 and then included in the regular production flow of injection molded material. Dewaxing and presintering was made in a vacuum furnace, the latter with 30 minutes hold in vacuum at 1200° C. Sintering was made in a sinterHIP with 30 minutes hold in 30 bar Ar at 1410° C. The properties of the obtained pieces were within both metallurgical and geometrical specifications.

EXAMPLE 7

A production-scale test was made in the following way. A ball mill was loaded with raw material, stearic acid, and milling liquid for the production of hard metal, as described in Example 1. To the blend was added a 30 wt % water solution of PEI as described in Example 1 so that the resulting PEI concentration was 0.13% of the raw material weight. The added liquid volume and milling time were both reduced by 15% with respect to standard values. A measurement of the slurry viscosity after milling showed 48 units. A measurement of the viscosity of standard slurry obtained with standard liquid volume and milling time showed 72 units. The lower viscosity made emptying of the ball mill easier. The volume of ethanol-water mixture used for rinsing of the mill could therefore be decreased by 15%. The resulting slurry volume after rinsing was hence decreased by 13%. The run time for spray drying could therefore be reduced by 14%. The obtained granules and the resulting hard metal after sintering were of standard quality.

The described embodiments of the present invention are intended to be illustrative rather than restrictive, and are not intended to represent every possible embodiment of the present invention. Various modifications can be made to the disclosed embodiments without departing from the spirit or scope of the invention as set forth in the following claims, both literally and in equivalents recognized in law.

We claim:

1. A method of making a slurry, the slurry comprising tungsten carbide, ethanol, water, and stearic acid, the method comprising adding PEI in an amount of 0.04–0.20 wt % of the raw material weight.

2. The method according to claim 1, comprising 0.05–0.20 wt % PEI, WC, Co, and less than 1 wt % TiC, NbC and TaC.

3. The method according to claim 1, comprising adding 0.04–0.18 wt % PEI to a slurry containing WC, Co and 1–15 wt % TiC, NbC and TaC.

4. A slurry comprising tungsten carbide, ethanol, water, stearic acid, and PEI in an amount of 0.04–0.20 wt % of the raw material weight.

5. The slurry according to claim 4, comprising 0.05–0.20 wt % PEI, WC, Co and less than 1 wt % total of TiC, NbC and TaC.

6. The slurry according to claim 4, comprising 0.04–0.18 wt % PEI, WC, Co and 1–15 wt % total of TiC, NbC and TaC.

7. A powder comprising tungsten carbide, stearic acid, and PEI in an amount of 0.04–0.20 wt %.

8. The powder according to claim 7, comprising 0.05–0.20 wt % PEI, WC, Co and less than 1 wt % total of TiC, NbC and TaC.

9. The powder according to claim 7, comprising 0.04–0.18 wt % PEI, WC, Co and 1–15 wt % total of TiC, NbC and TaC.

* * * * *